US009704426B2

(12) United States Patent
Harada et al.

(10) Patent No.: US 9,704,426 B2
(45) Date of Patent: Jul. 11, 2017

(54) DISPLAY DEVICE, DISPLAY SYSTEM, AND IMAGE PROCESSING CIRCUIT

(71) Applicant: Japan Display Inc., Tokyo (JP)

(72) Inventors: Tsutomu Harada, Tokyo (JP); Naoyuki Takasaki, Tokyo (JP); Toshiyuki Nagatsuma, Tokyo (JP); Hirokazu Tatsuno, Tokyo (JP)

(73) Assignee: Japan Display Inc., Tokyo (JP)

( * ) Notice: Subject to any disclaimer, the term of this patent is extended or adjusted under 35 U.S.C. 154(b) by 195 days.

(21) Appl. No.: 14/705,420

(22) Filed: May 6, 2015

(65) Prior Publication Data

US 2015/0339965 A1 Nov. 26, 2015

(30) Foreign Application Priority Data

May 23, 2014 (JP) ..... 2014-107578

(51) Int. Cl.

| | |
|---|---|
| ***G09G 3/36*** | (2006.01) |
| ***G09G 3/20*** | (2006.01) |
| ***G09G 3/34*** | (2006.01) |

(52) U.S. Cl.

CPC ..... *G09G 3/2003* (2013.01); *G09G 3/3406* (2013.01); *G09G 3/36* (2013.01); *G09G 2300/0452* (2013.01); *G09G 2320/064* (2013.01); *G09G 2320/0646* (2013.01); *G09G 2320/0673* (2013.01); *G09G 2360/16* (2013.01)

(58) Field of Classification Search

CPC .. G09G 3/2003; G09G 3/2074; G09G 3/3426; G09G 2320/0233; G09G 2320/0626; G09G 2320/0633; G09G 2320/0646; G09G 2320/0673

See application file for complete search history.

(56) References Cited

U.S. PATENT DOCUMENTS

| | | | | |
|---|---|---|---|---|
| 6,219,022 | B1 * | 4/2001 | Yamazaki | G09G 3/3666 345/103 |
| 6,603,456 | B1 * | 8/2003 | Aoki | G09G 3/3648 345/100 |
| 8,314,761 | B2 * | 11/2012 | Takada | G09G 3/3406 345/589 |

(Continued)

FOREIGN PATENT DOCUMENTS

JP 2010-20241 A 1/2010

*Primary Examiner* — Gene W Lee

(74) *Attorney, Agent, or Firm* — Michael Best & Friedrich LLP

(57) ABSTRACT

A display device includes a first processing circuit mounted on a substrate separate from a translucent substrate constituting a display panel, and a second processing circuit mounted on the translucent substrate. The first and the second processing circuits receive the same image data. The first processing circuit includes a determination unit that uses color values of a plurality of pixels constituting an image based on the image data to determine an expansion coefficient value serving as a value for improving luminance of the image, and outputs the expansion coefficient value to the second processing circuit. The second processing circuit includes an expansion processing unit that uses the expansion coefficient value to provide expansion processing for improving the luminance of the image for the image based on the image data.

6 Claims, 8 Drawing Sheets

(56) References Cited

U.S. PATENT DOCUMENTS

| | | | | |
|---|---|---|---|---|
| 2009/0086094 | A1* | 4/2009 | Lee | G09G 3/2003 348/453 |
| 2009/0207182 | A1* | 8/2009 | Takada | G09G 3/3406 345/589 |
| 2009/0213048 | A1* | 8/2009 | Park | G09G 3/2003 345/77 |
| 2010/0007679 | A1 | 1/2010 | Sakaigawa | |
| 2010/0013872 | A1* | 1/2010 | Masuda | G09G 3/3413 345/691 |
| 2011/0128438 | A1* | 6/2011 | Yamashita | G06T 1/00 348/384.1 |
| 2011/0181635 | A1* | 7/2011 | Kabe | G09G 3/3426 345/694 |
| 2011/0298944 | A1* | 12/2011 | Kuo | H04N 9/045 348/223.1 |
| 2012/0206513 | A1* | 8/2012 | Ueno | G09G 3/3413 345/697 |
| 2012/0249610 | A1* | 10/2012 | Katagami | G09G 3/3426 345/690 |
| 2012/0249613 | A1* | 10/2012 | Takada | G09G 3/3406 345/690 |
| 2016/0042698 | A1* | 2/2016 | Yang | G09G 3/2096 345/690 |

* cited by examiner

DISPLAY DEVICE, DISPLAY SYSTEM, AND IMAGE PROCESSING CIRCUIT

CROSS-REFERENCE TO RELATED APPLICATIONS

This application claims priority from Japanese Application No. 2014-107578, filed on May 23, 2014, the contents of which are incorporated by reference herein in its entirety.

BACKGROUND

1. Technical Field

The present disclosure relates to a display device, a display system, and an image processing circuit.

2. Description of the Related Art

Image processing (expansion processing) is known that improves luminance of a plurality of pixels constituting an image displayed on a display device according to image data (refer to Japanese Patent Application Laid-open Publication No. 2010-20241 (JP-A-2010-20241)).

Conventional image processing circuits that perform the expansion processing are circuits in which an entire configuration for expanding image data is integrated into one circuit. This configuration makes the circuit larger and more costly. The larger circuit in size requires a larger mounting space, thus making it difficult to reduce in size the display device on which the circuit is mounted.

For the foregoing reasons, there is a need for a display device, a display system, and an image processing circuit in which a circuit for performing a expansion processing is reduced in size.

SUMMARY

According to an aspect, a display device includes a first processing circuit mounted on a substrate separate from a translucent substrate constituting a display panel, and a second processing circuit mounted on the translucent substrate. The first and the second processing circuits receive the same image data. The first processing circuit includes a determination unit that uses color values of a plurality of pixels constituting an image based on the image data to determine an expansion coefficient value serving as a value for improving luminance of the image, and outputs the expansion coefficient value to the second processing circuit. The second processing circuit includes an expansion processing unit that uses the expansion coefficient value to provide expansion processing for improving the luminance of the image for the image based on the image data.

According to another aspect, a display system includes a display device that includes a processing circuit mounted on a translucent substrate constituting a display panel, and a calculation device that uses software processing to determine an expansion coefficient value serving as a value for improving luminance of an image and outputs the expansion coefficient value and image data to the processing circuit. The processing circuit includes an expansion processing unit that uses the expansion coefficient value to provide expansion processing for improving the luminance of the image for the image based on the image data.

According to still another aspect, an image processing circuit is mounted on a substrate separate from a translucent substrate constituting a display panel. The image processing circuit receives from the outside thereof an expansion coefficient value and image data and the expansion coefficient value being determined using color values of a plurality of pixels constituting an image and serving as a value for improving luminance of the image. The image processing circuit includes an expansion processing unit that uses the expansion coefficient value to provide expansion processing for improving the luminance of the image for the image based on the image data.

DETAILED DESCRIPTION

Figure 1:
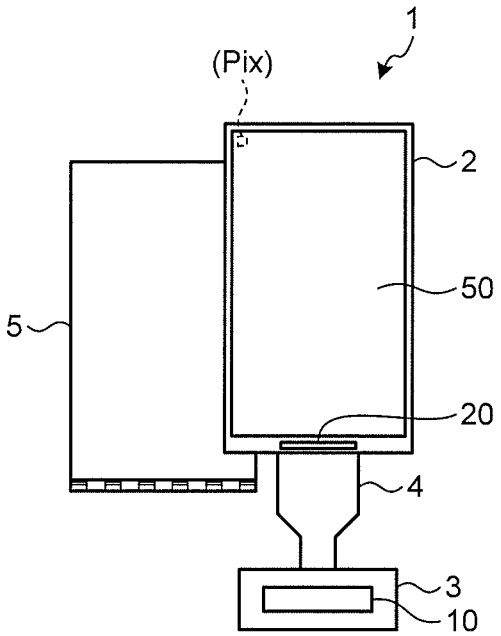
FIG. 1 is a diagram illustrating an example of a form of a display device according to a first embodiment of the present invention.

The following describes preferred embodiments of the present invention with reference to the drawings. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example, and interpretation of the invention is not limited thereto. The same element as that described in the drawing that has already been discussed is denoted by the same reference numeral through the description and the drawings, and detailed description thereof will not be repeated in some cases.

First Embodiment

Figure 2:
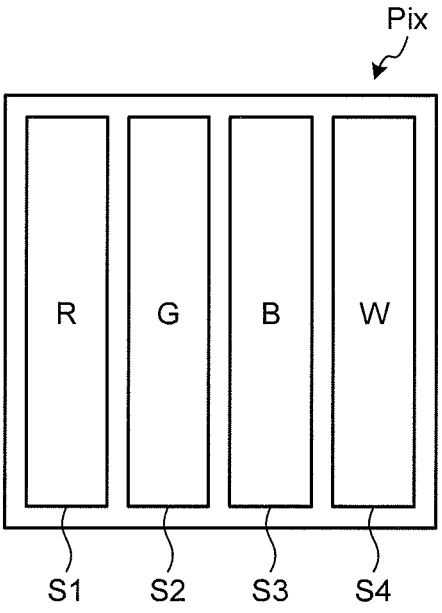
FIG. 2 is a diagram illustrating a configuration example of a pixel.

A first embodiment of the present invention will first be described. FIG. 1 is a diagram illustrating an example of a form of a display device 1 according to the first embodiment of the present invention. FIG. 2 is a diagram illustrating a configuration example of a pixel Pix. The display device 1 includes a display panel 2, a substrate 3, and a wiring unit. The display panel 2 is a panel made of a translucent substrate (such as a glass substrate) constituting a liquid crystal display. The translucent substrate consists, for example, of a pixel substrate on which wiring having a matrix structure (such as scanning lines and signal lines) is formed, a counter substrate that sandwiches liquid crystals in cooperation with the pixel substrate, and the like, which are provided on a display unit 50. A circuit (second processing circuit 20) for image processing is mounted on the translucent substrate of the display panel 2.

The display device 1 according to the first embodiment is, for example, a transmissive liquid crystal display device, and performs display output using a backlight 5 as a light source. The display unit 50 (such as a liquid crystal display) provided on the display panel 2 of the first embodiment reproduces a color of one pixel (such as the pixel Pix illustrated in FIGS. 1 and 2) with a combination of four sub-pixels (such as sub-pixels S1 to S4 illustrated in FIG. 2) of red (R), green (G), blue (B), and single-color white (W) (RGBW). While FIG. 1 illustrates the backlight 5 in a position displaced from the display panel 2, the backlight 5 is actually provided on the back surface of the display panel 2. FIG. 1 merely schematically illustrates the pixel Pix on the display unit 50, and does not represent the actual relative proportion in size.

The pixel Pix illustrated in FIG. 2 is a square pixel having the vertically long rectangular sub-pixels S1 to S4. However, the shapes and the like of the pixel and the sub-pixels are merely examples, and are not limited to these examples. For example, the pixel may have square sub-pixels that are vertically and horizontally arranged in a positional relation of 2 (pixels) by 2 (pixels). Any of the sub-pixels may have an aperture area larger than that of the other sub-pixels, or any of the sub-pixels may have an aperture area smaller than that of the other sub-pixels.

The substrate 3 is, for example, a printed circuit board, and a substrate separate from the translucent substrate constituting the display panel 2. The substrate 3 has a circuit (first processing circuit 10) mounted thereon that is a circuit for image processing and differs from the circuit mounted on the translucent substrate of the display panel 2. The substrate 3 is coupled with a host CPU (not illustrated) and the like. The wiring unit is, for example, a flexible printed circuit board 4, and couples the display panel 2 with the substrate 3.

The first processing circuit 10 and the second processing circuit 20 cooperate with each other to perform the image processing including calculation processing to improve luminance of a plurality of pixels constituting an image. The image refers to a display image displayed on the display device 1 based on image data received from the outside. The first processing circuit 10 uses color values of the pixels constituting the image based on the image data that is output, for example, from the host CPU coupled with the substrate 3 to determine an expansion coefficient value that is a value for improving the luminance of the image. The second processing circuit 20 uses the expansion coefficient value to perform, for example, expansion processing for improving the luminance of the image.

The following describes the image processing in the first embodiment. In the following description, signals with respect to one of the pixels constituting the image based on the image data before the image processing will be termed "input image signals", and a combination of color values of R, G, and B represented by the signals will be represented as (R, G, B)=(Ri, Gi, Bi). In the above expression, Ri, Gi, and Bi are integer values in the range from the minimum value to the maximum value (for example, from 0 to 255) representing the color values of R, G, and B, respectively. In other words, the input image signals in the first embodiment are RGB digital signals that can express the color values of the respective colors each in 8 bits.

First, the following describes a basic principle in the case of replacing the combination of color values of R, G, and B represented by the input image signals with a combination of color values of R, G, B, and W. Suppose a case in which the input image signals are RGB digital signals such as those described above. In this case, denoting signals for displaying colors with the pixel of RGBW as Ro, Go, Bo, and Wo, the following expression (1) needs to be satisfied to prevent display quality of a display video from changing.

$$Ri:Gi:Bi=(Ro+Wo):(Go+Wo):(Bo+Wo) \quad (1)$$

Denoting the maximum values of the signals Ri, Gi, and Bi as Max(Ri, Gi, Bi), the following expressions (2) to (4) are satisfied. Hence, the following expressions (5) to (7) are satisfied.

$$Ri/\mathrm{Max}(Ri,Gi,Bi)=(Ro+Wo)/(\mathrm{Max}(Ri,Gi,Bi)+Wo) \quad (2)$$

$$Gi/\mathrm{Max}(Ri,Gi,Bi)=(Go+Wo)/(\mathrm{Max}(Ri,Gi,Bi)+Wo) \quad (3)$$

$$Bi/\mathrm{Max}(Ri,Gi,Bi)=(Bo+Wo)/(\mathrm{Max}(Ri,Gi,Bi)+Wo) \quad (4)$$

$$Ro=Ri\times((\mathrm{Max}(Ri,Gi,Bi)+Wo)/\mathrm{Max}(Ri,Gi,Bi)Wo \quad (5)$$

$$Go=Gi\times((\mathrm{Max}(Ri,Gi,Bi)+Wo)/\mathrm{Max}(Ri,Gi,Bi)Wo \quad (6)$$

$$Bo=Bi\times((\mathrm{Max}(Ri,Gi,Bi)+Wo)/\mathrm{Max}(Ri,Gi,Bi)Wo \quad (7)$$

In the above expressions, a settable value of Wo can be defined as a function of the minimum values Min(Ri, Gi, Bi) of Ri, Gi, and Bi by the following expression (8). In the expression (8), f is any coefficient. Specifically, according to the simplest concept, Wo is represented by the following expression (9).

$$Wo=f(\mathrm{Min}(Ri,Gi,Bi) \quad (8)$$

$$Wo=\mathrm{Min}(Ri,Gi,Bi) \quad (9)$$

As is understood from the above expressions (8) and (9), presence of image signals that satisfies Min(Ri, Gi, Bi)=0 results in Wo=0. In this case, the luminance of the pixel is not improved. Even if Min(Ri, Gi, Bi) is not 0, the Min(Ri, Gi, Bi) having a small value close to 0 makes the value of Wo small, so that the degree of improvement in luminance is small.

Furthermore, the first and the second processing circuits 10 and 20 provide the image processing for all pixels of one image. Due to this processing, simply following the basic principle can cause a video to be exceedingly bright at a part thereof, and not bright at the other part. Because of this, for example, if a portion with high saturation (such as a single-color portion) lies on a bright background with low saturation, although a relatively large value of Wo can be set for the background, a relatively small value of Wo is set for the portion with high saturation.

In general, human sensitivity to color and brightness (visual performance) is highly influenced by relative differences in brightness compared with the surroundings, so that a portion with relatively low brightness (such as the above-mentioned single-color portion) may look dark and dull. This phenomenon is called simultaneous contrast. In the first embodiment, to resolve problems regarding the simultaneous contrast in the image processing of replacing the color represented by the RGB input image signals with the combination of RGBW colors, WhiteMagic processing is performed that includes the calculation processing (expansion processing) for improving the luminance of the pixels constituting the image displayed according to the image data. The following describes the WhiteMagic processing.

The expansion processing of the input image signals will first be described. An expansion processing unit 22 of the second processing circuit 20 (refer to FIG. 6) expands the input image signals Ri, Gi, and Bi so as to maintain the ratio therebetween, as represented by the following expressions (10) to (12). In the expressions (10) to (12), a is a natural number.

$$Rj=\alpha\times Ri \quad (10)$$

$$Gj=\alpha\times Gi \quad (11)$$

$$Bj=\alpha\times Bi \quad (12)$$

To maintain display quality of the image signals, the expansion processing unit 22 desirably performs the expansion processing so as to maintain the ratio of the color values of R, G, and B (luminance ratio). The expansion processing unit 22 also desirably expands the input image signals so as to maintain the gradation-luminance characteristic (gamma characteristic) of the input image signals. If the color space after the image processing is an RGB color space, the expansion processing has limitations. In particular, if the color represented by the input image signals is already a bright color, the input image signals can hardly be expanded in some cases.

In contrast, the display device 1 according to the present embodiment is an RGBW display device that has the W color added thereto and has a wider dynamic range, so that an expanded color space can be displayed. The expansion processing is performed up to an upper limit value of the color space constituted by R, G, B, and W. Because of this, the expansion processing allows the limit value of 255 in the conventional RGB color space to be exceeded.

For example, if the brightness of the W pixel is K times the brightness of the RGB pixels, the maximum value of Wo can be considered to be 255×K. In this case, each value (luminance) of Rj, Gj, and Bj can reach (1+K)×255 in the RGBW color space. Because of this, the luminance can be improved for the conventionally problematic data that satisfies Min(Ri, Gi, Bi)=0 or that has small values.

Figure 3:
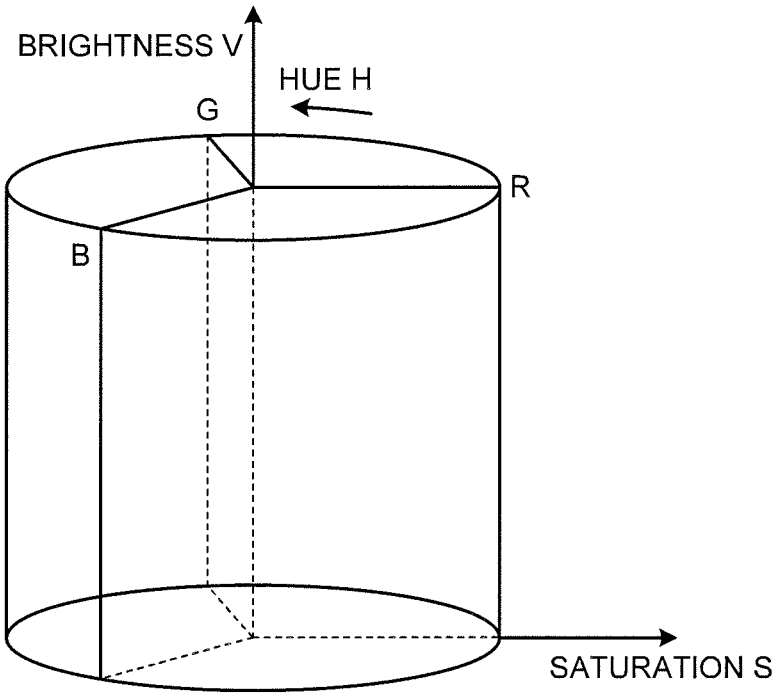
FIG. 3 is a diagram illustrating a color space of an RGB display device.
Figure 4:
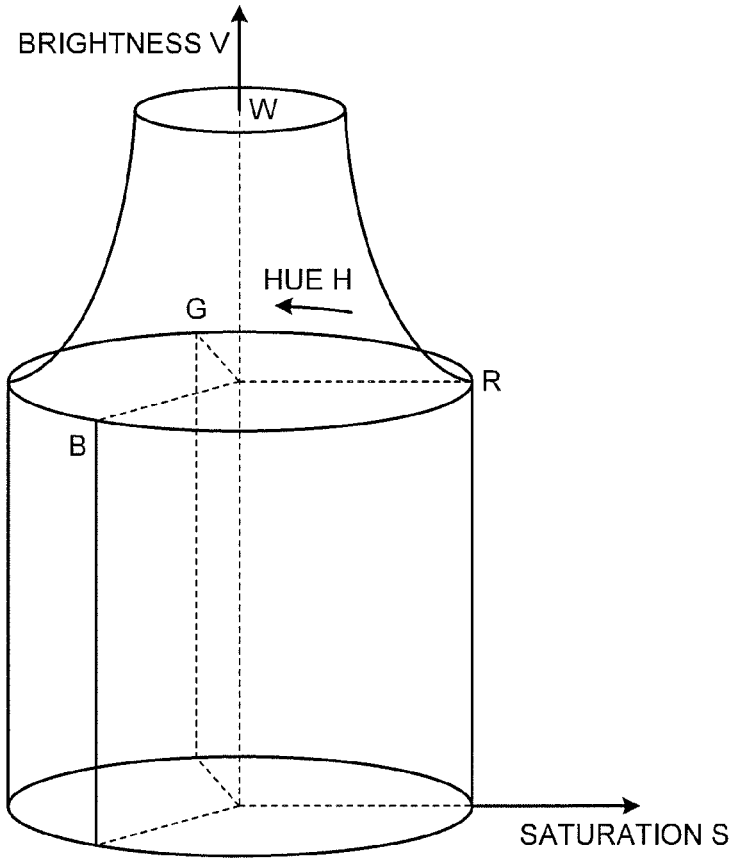
FIG. 4 is a diagram illustrating a color space of an RGBW display device.

FIG. 3 is a diagram illustrating a color space of the RGB display device. FIG. 4 is a diagram illustrating a color space of the RGBW display device. As illustrated in FIG. 3, all colors can be plotted in coordinates defined by hue (H), saturation (S), and value of brightness (V). An HSV color space that is a type of color space is defined by these attributes of hue, saturation, and brightness. The hue refers to a difference between colors, such as red, green, and blue, and is an attribute that can most effectively represent differences in impression. The saturation is one of indicators that represent a color, and an attribute that indicates a degree of vividness of a color. The brightness is an attribute that indicates a degree of brightness of a color. A larger value of the brightness is expressed as a brighter color. In the HSV color space, the hue represents R at 0 degrees, and represents G and B while turning counterclockwise to complete a full circle. The saturation represents how much gray is mixed with each color and how dull the color is. The saturation of 0% represents a case in which the color is dullest, and the saturation of 100% represents a case in which the color is least dull. The brightness of 100% represents a case in which the color is brightest, and the brightness of 0% represents a case in which the color is darkest.

As illustrated in FIG. 4, although attributes defining the color space of the RGBW display device are basically the same as the attributes defining the color space of the RGB display device, the brightness is expanded by addition of W. In this way, the difference in color space between the RGB display device and the RGBW display device can be represented by the HSV color space defined by the hue (H), the saturation (S), and the brightness (V). According to this, the dynamic range of the brightness (V) expanded by addition of W is found to greatly vary with the saturation (S).

The WhiteMagic processing technology focuses on the fact that the coefficient α of the expansion processing of the signals Ri, Gi, and Bi that are the above-described input image signals vary with the saturation (S). Specifically, an image analysis unit 12 of the first processing circuit 10 (refer to FIG. 6) analyzes the input image signals. Then, according to the result of the analysis by the image analysis unit 12, an α-value determination unit 13 of the first processing circuit 10 (refer to FIG. 6) determines the expansion coefficient value (α) for each image. This processing allows the RGBW display device to display the video while maintaining the display quality before the image processing.

At this time, the α-value determination unit 13 preferably determines the expansion coefficient value (α) for each value of the saturation (S) ranging from 0 to the maximum value (255 in the case of an 8-bit value) by analyzing the input image signals. The α-value determination unit 13 may employ the minimum value of the expansion coefficient values (α) thus obtained. In this case, the expansion processing can be performed without any reduction in the display quality before the image processing. In the first embodiment, the expansion processing is performed based on ratios between the value of Max(R, G, B) of the input image and maximum brightness values V in the HSV color space. The α-value determination unit 13 calculates the ratios for saturation values S from 0 to the maximum value, and uses the minimum value of the ratios as the expansion coefficient value (α) to perform the expansion processing.

To fully maintain the display quality, the input image signals of all pixels constituting one piece of image data are preferably analyzed. The analysis mentioned above refers to processing for obtaining Min(Ri, Gi, Bi) and Max(Ri, Gi, Bi). The image analysis unit 12 performs this processing. To increase the processing speed in the WhiteMagic processing and reduce the circuit scale of the image analysis unit 12 and a circuit including the image analysis unit 12, the analysis is preferably performed by sampling the pixels constituting the image data. Specifically, the image analysis unit 12 analyzes the input image signals, for example, at intervals of every n pixels (where n is a natural number of 1 or larger). Furthermore, an ergonomic approach can naturally be used as a method for determining the expansion coefficient value (α).

A mere slight local change in the signals Ri, Gi, and Bi that are the input image signals cannot cause human perception. Consequently, the expansion coefficient value (α) is increased to the perception limit of the display quality change so that the signals can be expanded without causing the perception of the display quality change. In other words, the second processing circuit 20 performs the expansion processing within a range in which the display quality change is not perceivable.

Figure 5:
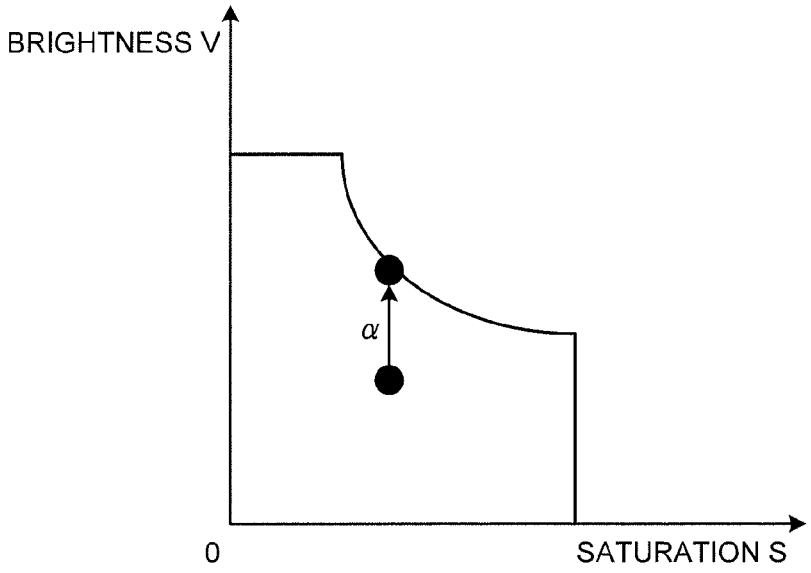
FIG. 5 is a sectional view of an extended color space of the RGBW display device.

As illustrated in FIG. 5, signals (color values) after the image processing are generated based on the expansion coefficient value (α) determined by comparing the levels of the input image signals with respect to the expanded RGBW color space.

Expanding the input image signals with the above-described method can set Wo to a large value, and can further improve the luminance of the entire video. The transmissive liquid crystal display device allows the video to be displayed at exactly the same luminance as that of the input image signals by reducing the luminance of the backlight 5 by a factor of $1/\alpha$ according to the expansion coefficient value ($\alpha$).

The following describes a method for determining Wo based on the expanded image signals Rj, Bj, and Gj. As described above, the expanded image signals Rj, Bj, and Bj are preferably analyzed to obtain a minimum value Min(Rj, Gj, Bj) of each pixel and set Wo to Min(Ri', Gi', Bi'). This is the maximum possible value of Wo. Consequently, to determine Wo, the expanded image signals Rj, Gj, and Bj are analyzed to obtain the minimum value Min(Rj, Gj, Bj), which is set as Wo.

If Wo is determined by the above-described method, new RGB image signals are obtained as given by the following expressions (13) to (15).

$$Ro=RjWo \tag{13}$$

$$Go=GjWo \tag{14}$$

$$Bo=BjWo \tag{15}$$

Expanding the input image signals with the above-described method can set Wo to a larger value, and can further improve the luminance of the entire image. Reducing the luminance of the backlight 5 by a factor of $1/\alpha$ according to the expansion coefficient value ($\alpha$) can display the image at exactly the same luminance as that of the input image signals.

The color values after the expansion processing described above are generated based on the expansion coefficient value ($\alpha$) determined by comparing the brightness level of the input image signals with respect to the color space formed by RGBW components. Consequently, the expansion coefficient value ($\alpha$) is image analysis information obtained as a result of analysis of an image of one frame. The use of this information for converting the image signals of the next frame allows appropriate RGBW conversion to be performed without storing the image signals in a frame memory.

The expansion coefficient value ($\alpha$) is determined by comparing the brightness level of the input image signals with respect to the color space, and consequently does not change even if the image information changes to some extent. For example, even when an image moves about on the screen, the expansion coefficient value ($\alpha$) remains unchanged unless the luminance or chromaticity greatly changes. Consequently, no problem is caused by the RGBW conversion performed using the expansion coefficient value ($\alpha$) determined for the previous frame.

In the first embodiment, gamma conversion units 11 and 21 perform gamma conversion processing before the image analysis by the image analysis unit 12 and the expansion processing by the expansion processing unit 22, which are to be described later. The gamma conversion processing changes the values of (Rj, Gj, Bj) so that, for example, a correspondence relation between a gradation of the image of the input image signals and the luminance of the image, that is, a gradation-luminance characteristic (gamma characteristic) results in a linear relation. The image analysis unit 12 of the first embodiment analyzes the input image signals that have been subjected to gamma conversion processing. A reverse gamma conversion unit 23 returns the gradation-luminance characteristic (gamma characteristic) that has been changed through the gamma conversion processing by the gamma conversion unit 21 to the correspondence relation before the gamma conversion processing. The gradation-luminance characteristic (gamma characteristic) of the input image signals can be more surely maintained through the gamma conversion processing before the analysis processing and the reverse gamma conversion processing after the expansion processing. The gamma conversion processing and the reverse gamma conversion processing may be omitted.

Figure 6:
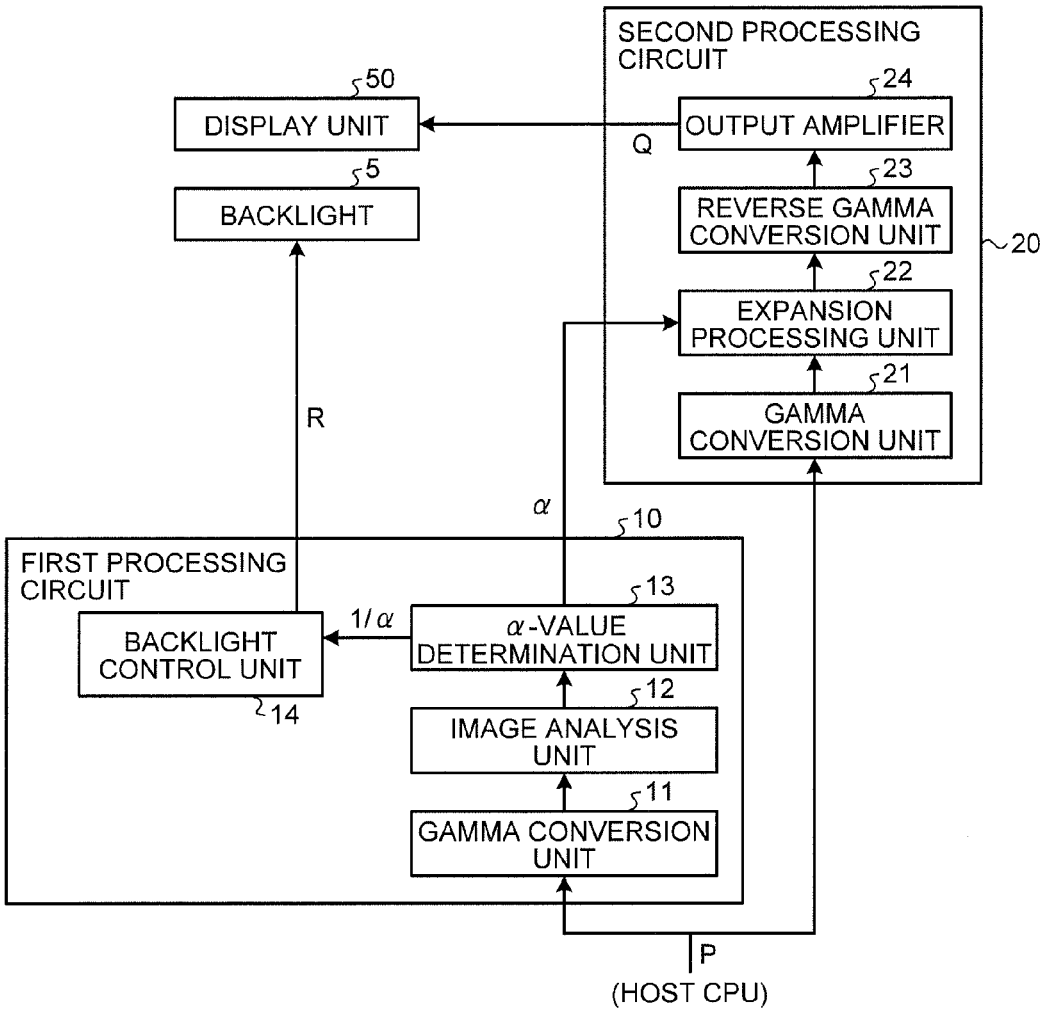
FIG. 6 is a block diagram illustrating main functions of an image processing device.

The following describes the flow of the image processing in the first embodiment. FIG. 6 is a block diagram illustrating main functions of an image processing device. In block diagrams such as that in FIG. 6, reference numeral P represents the input image signals before the image processing. Reference numeral Q represents the signals after the image processing. The block diagram illustrates the expansion coefficient value ($\alpha$), and illustrates the reciprocal of the expansion coefficient value ($\alpha$) as $1/\alpha$. As illustrated in FIG. 6, the input image signals before the image processing are output from the host CPU to both the first processing circuit 10 and the second processing circuit 20.

The first processing circuit 10 includes the gamma conversion unit 11, the image analysis unit 12, and the $\alpha$-value determination unit 13. The gamma conversion unit 11 performs the gamma conversion processing to convert the correspondence relation between the gradation of the image based on the image data and the luminance of the image into a predetermined relation. Specifically, the gamma conversion unit 11 changes the values of (Rj, Gj, Bj) so that the gradation-luminance characteristic (gamma characteristic) of the input image signals before the image processing results in a linear relation. The image analysis unit 12 analyzes the input image signals. The $\alpha$-value determination unit 13 uses the results of the analysis by the image analysis unit 12, that is, the color values of the pixels constituting the image (such as the image after being subjected to the gamma conversion processing) based on the image data to determine the expansion coefficient value ($\alpha$) that is a value for improving the luminance of the image, and outputs the expansion coefficient value ($\alpha$) to the second processing circuit 20.

The second processing circuit 20 includes the gamma conversion unit 21, the expansion processing unit 22, the reverse gamma conversion unit 23, and an output amplifier 24. In the same manner as in the case of the gamma conversion unit 11 of the first processing circuit 10, the gamma conversion unit 21 of the second processing circuit 20 performs the gamma conversion processing to convert the correspondence relation between the gradation of the image based on the image data and the luminance of the image into the predetermined relation. The expansion processing unit 22 uses the expansion coefficient value ($\alpha$) output from the first processing circuit 10 to provide the expansion processing for the image (such as the image after the gamma conversion processing) based on the image data to improve the luminance of the image. Specifically, the expansion processing unit 22 performs the expansion processing by applying the expansion coefficient value ($\alpha$) determined from the results of analysis of a plurality of pixels constituting one image to each of the pixels constituting the image, and thus obtains the expanded image signals. The reverse gamma conversion unit 23 returns the correspondence relation between the gradation of the image converted by the expansion processing unit 22 and the luminance of the image to the correspondence relation before the gamma conversion processing. The output amplifier 24 amplifies signals corresponding to the image data after the expansion processing (such as signals after being subjected to the reverse gamma conversion processing), and outputs the results to the display unit 50.

The first processing circuit 10 of the first embodiment includes a backlight control unit 14. The backlight control unit 14 performs operation control of the backlight 5, such as turning on/off the backlight 5 and controlling the brightness during lighting. Specifically, the backlight control unit 14 controls voltage for lighting the backlight 5 using, for example, PWM control. In block diagrams such as that in FIG. 6, reference numeral R represents outputs (such as a PWM signal) related to the backlight control.

The α-value determination unit 13 outputs the reciprocal (1/α) of the expansion coefficient value (α) to the backlight control unit 14. According to the reciprocal, the backlight control unit 14 reduces the luminance of the backlight 5 by a factor of 1/α relative to the luminance of the backlight 5 obtained when the backlight control is not applied based on the reciprocal of the expansion coefficient value. This operation can reduce power consumption by the backlight 5 while displaying the image at exactly the same luminance as that of the input image signals. The backlight control as described above is merely an example, and can be varied as appropriate. For example, to brighten or darken the entire image, the luminance of the backlight 5 may be increased or reduced as a whole relative to the luminance under the backlight control based on the reciprocal of the expansion coefficient value.

The following describes a relation between an image used for determining the expansion coefficient value (α) and an image to which the expansion coefficient value (α) is applied. In the first embodiment, each frame image of image data including a plurality of such frame images is supplied to the first and the second processing circuits 10 and 20 at the same time. Examples of such image data include, but are not limited to, image data including a plurality of images (frame images) used to update an image of the display unit 50 at a certain refresh rate.

In the first embodiment, the expansion processing unit 22 employs, as the expansion coefficient value to be used by the expansion processing unit 22 for the expansion processing of a certain frame image, an expansion coefficient value determined using pixels of a frame image different from the certain frame image. Specifically, the expansion processing unit 22 employs, as the expansion coefficient value to be used for the expansion processing of a certain frame image, an expansion coefficient value determined using pixels of a frame image immediately before the certain frame image.

Figure 7:
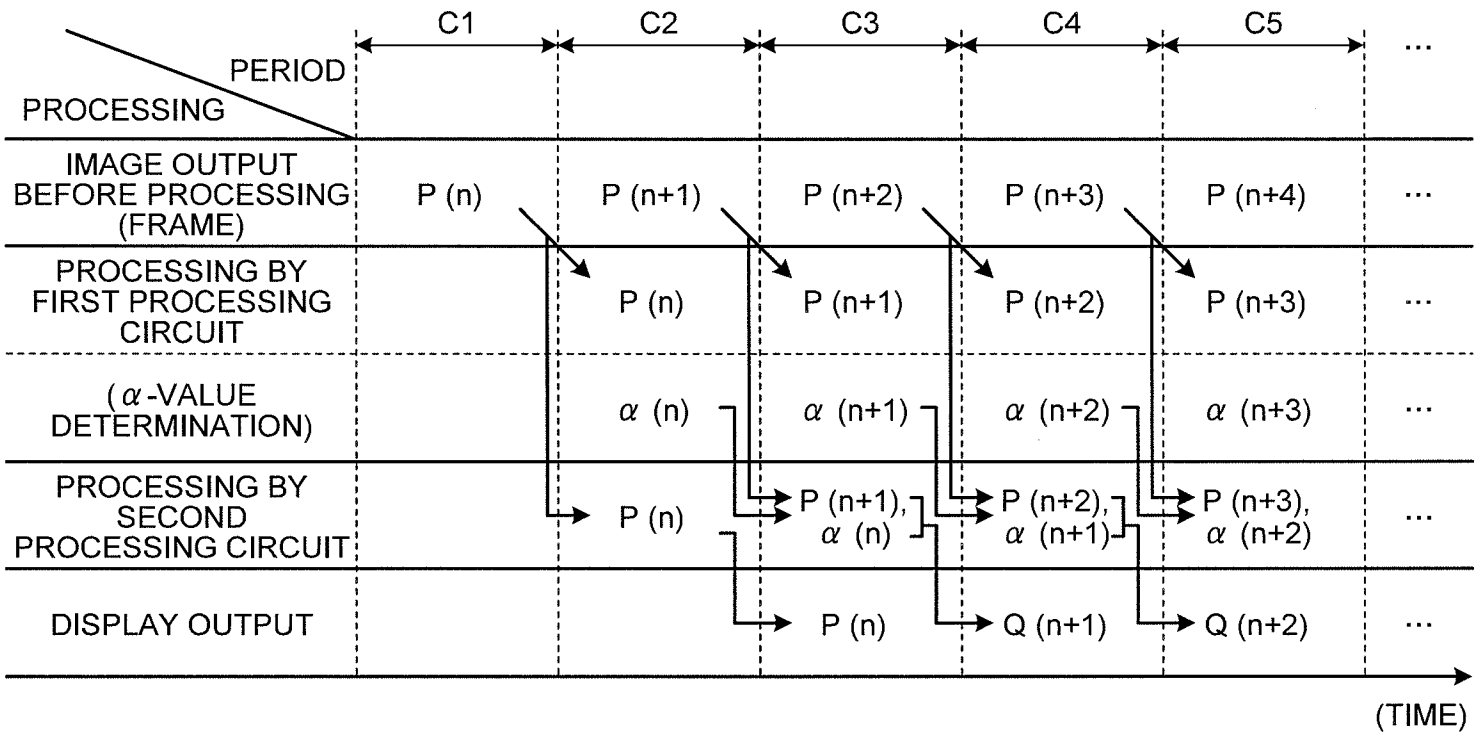
FIG. 7 is a timing diagram illustrating an example of relations between times at which α-values are determined and times of the expansion processing in which the α-values are used.

FIG. 7 is a timing diagram illustrating an example of relations between times at which α-values are determined and times of the expansion processing in which the α-values are used. FIG. 7 illustrates, frame by frame, output timing of the input image signals corresponding to a plurality of pixels constituting one frame image. Periods C1 to C5 illustrated in FIG. 7 are periods of time, during each of which the frame image is processed. In FIG. 7, to distinguish the input image signals of a plurality of continuous frame images, the input image signals are represented such as P(n), P(n+1), P(n+2), and P(n+3). Signals Q(n+1) after subjected to the image processing are signals of the frame image corresponding to the input image signals of P(n+1).

As illustrated in FIG. 7, first, in the period C1, the input image signals of P(n) are output as an image output before processing from the host CPU to the first and the second processing circuits 10 and 20. In the next period C2 after the image output of P(n) before processing is completed, the first and the second processing circuits 10 and 20 provide in parallel the image processing for the input image signals of P(n). In the image processing, the α-value determination unit 13 of the first processing circuit 10 determines the expansion coefficient value (α) corresponding to the input image signals of P(n). The expansion coefficient value (α) has not been output to the second processing circuit 20 in the period C2, so that the expansion processing unit 22 of the second processing circuit 20 performs the image processing without the expansion coefficient value (α). Specifically, the second processing circuit 20 applies the image processing of improving the luminance of the image to the input image signals of P(n), for example, as described above in the description of the basic principle.

In the next period C3 after the second processing circuit 20 has completed the processing of the input image signals of P(n), the display output is performed according to the P(n). The image output of P(n+1) before processing having been performed during the period C2 has completed by the time of period C3, so that the first and the second processing circuits 10 and 20 provide in parallel the image processing for the input image signals of P(n+1). The expansion coefficient value (α(n)) corresponding to the input image signals of P(n) has been output to the second processing circuit 20 by the time of period C3, so that the expansion processing unit 22 of the second processing circuit 20 uses the expansion coefficient value (α(n)) corresponding to P(n) to provide the expansion processing for the input image signals of P(n+1). In the next period C3 after the second processing circuit 20 has completed the processing of the input image signals of P(n+1), the signals Q(n+1) after being subjected to the expansion processing are output as the display output. Subsequently, in the same manner, the expansion coefficient value (α) is determined using pixels of a frame image immediately before the frame image to be subjected to the expansion processing, and is used for the expansion processing. Specifically, for example, the expansion coefficient value (α(n+1)) corresponding to P(n+1) is used to provide the expansion processing for the input image signals of P(n+2) during the time of period C4, and the signals Q(n+2) are output as the display output during the time of period C5.

As described above, according to the first embodiment, a circuit for performing the expansion processing is divided into the two circuits, that is, the first and the second processing circuits 10 and 20, so that each of the processing circuits can be reduced in size. As a result, a space needed for providing each of the processing circuits can be smaller. Thus, smaller-scale circuits can be used to perform the expansion processing. In particular, because the second processing circuit 20 mounted on the translucent substrate of the display panel 2 can be reduced in size, the manufacturing cost of the display panel 2 can be reduced.

The expansion coefficient value (α) is determined using the pixels of the image after the gamma conversion processing, and the image after the gamma conversion processing is subjected to the expansion processing and the reverse gamma conversion processing, whereby the expansion processing can be performed while more surely maintaining the correspondence relation between the gradation of the image and the luminance of the image. When the image data after being subjected to the gamma conversion processing is transmitted to the second processing circuit 20 that performs the reverse gamma conversion processing, the data volume of the image data increases because, for example, information for the reverse gamma conversion processing is added. Due to this, the data transmission time increases, and power consumption caused by the data transmission also increases. In the present embodiment, the second processing circuit 20 includes the gamma conversion processing unit, so that the image data before the gamma conversion processing having a smaller data volume only needs to be transmitted to the second processing circuit 20. This reduction in data volume can reduce problems, such as the increase in the data transmission time and the increase in the power consumption.

The expansion processing unit 22 employs, as the expansion coefficient value to be used by the expansion processing unit 22 for the expansion processing of a certain frame image, an expansion coefficient value determined using pixels of a frame image immediately before the certain frame image. As a result, necessity of a frame memory can be eliminated, and the display device 1 that is lower in cost and power consumption can be provided.

Second Embodiment

Figure 8:
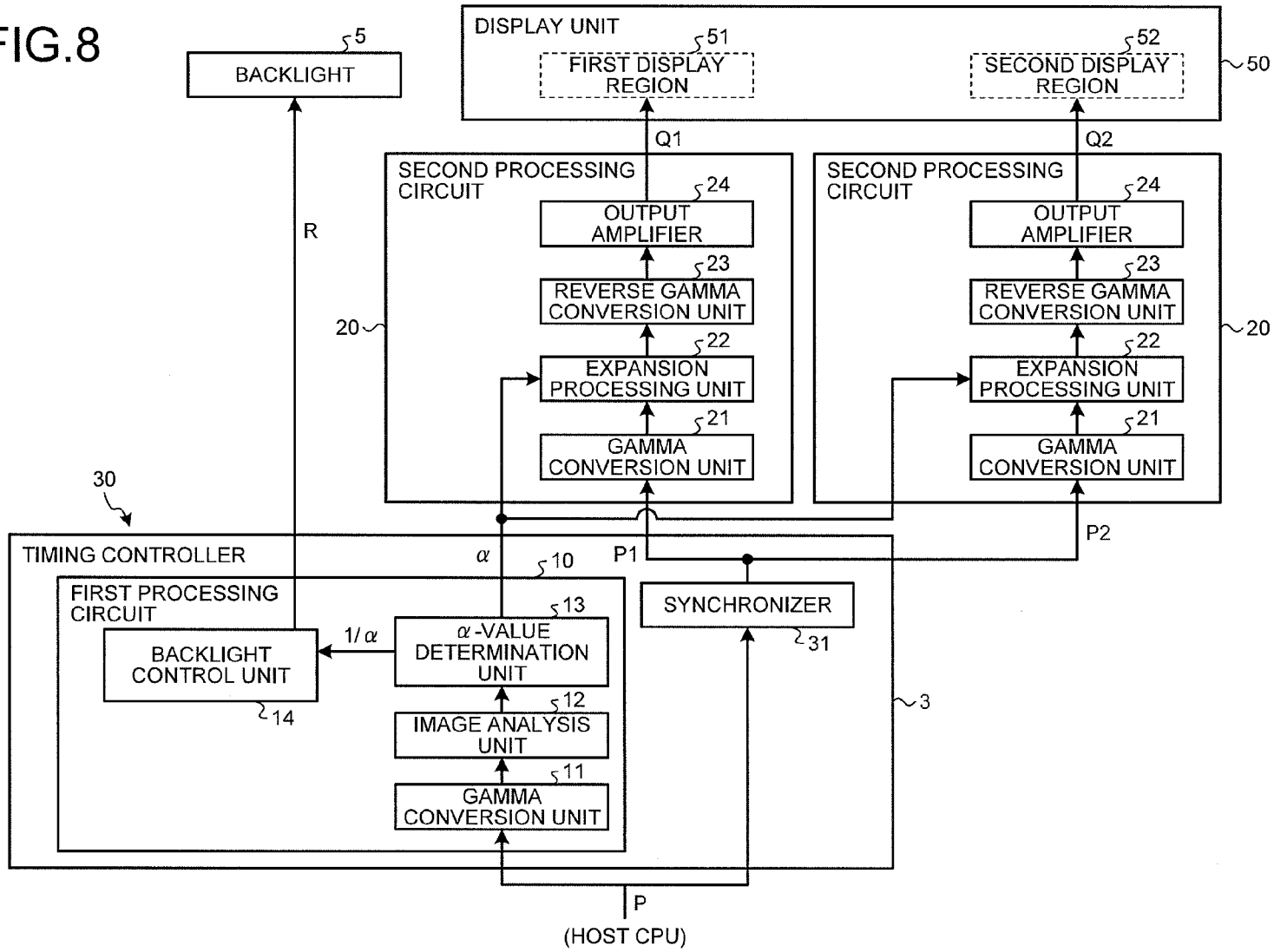
FIG. 8 is a diagram illustrating an example of a form of a display device according to a second embodiment of the present invention.

A second embodiment of the present invention will be described. FIG. 8 is a diagram illustrating an example of a form of a display device according to the second embodiment of the present invention. In the description of the second embodiment, the same configuration as that of the first embodiment is denoted by the same reference numeral, and description thereof will be omitted in some cases. The display device of the second embodiment includes a plurality of second processing circuits 20. Specifically, as illustrated in FIG. 8, two second processing circuits 20 are mounted on the translucent substrate of the display panel 2. The second processing circuits 20 perform the expansion processing of images displayed on different display regions on the display unit 50. FIG. 8 illustrates a case in which the two second processing circuits 20 are provided, and a first display region 51 and a second display region 52 are provided in the display area of the display unit 50. In FIG. 8, reference numeral Q1 represents signals after the image processing that are output from one of the two second processing circuits 20 to the first display region 51, and reference numeral Q2 represents signals after the image processing that are output from the other of the two second processing circuits 20 to the second display region 52. The α-value determination unit 13 in the first processing circuit 10 of the second embodiment outputs the expansion coefficient value (α) to the second processing circuits 20.

The display device according to the second embodiment includes a timing controller 30 that synchronizes the second processing circuits 20 with each other. Specifically, the substrate 3 in the second embodiment is one configuration of the timing controller 30. The substrate 3 in the second embodiment is provided with a synchronizer 31. The synchronizer 31 synchronizes the second processing circuits 20. Specifically, the synchronizer 31 outputs the input image signals represented by reference numeral P in FIG. 8 so as to be distributed to the display regions corresponding to the respective second processing circuits 20. More specifically, the synchronizer 31 outputs the input image signals to each of the second processing circuits 20 that performs the expansion processing for the display region corresponding to coordinates indicated by the input image signals. When outputting the input image signals of a plurality of pixels constituting one image so as to be distributed to the second processing circuits 20, the synchronizer 31 outputs the distributed input image signals to the second processing circuits 20 on a parallel time basis. As a result, the times of output of the signals after the image processing by the respective second processing circuits 20 are synchronized with each other. In FIG. 8, reference numerals P1 and P2 are given to the input image signals distributed to the two second processing circuits 20.

The synchronizer 31 may, but need not, include a frame memory. If no frame memory is included, the synchronizer 31 sequentially outputs the input image signals output from the host CPU without buffering them. In this case, the image used for determining the expansion coefficient value (α) is related with the image to which the expansion coefficient value (α) is applied in the same manner as the first embodiment, as illustrated in FIG. 7. If the synchronizer 31 includes a frame memory, any relation can be employed as the relation between the timing with which the α-values are determined and the timing of the expansion processing with which the determined α-values are used. For example, if a frame memory for one frame is provided, the output timing of the input image signals to each of the second processing circuits 20 can be delayed by one frame. As a result, the image used for determining the expansion coefficient value (α) can be the same as the image to which the expansion coefficient value (α) is applied.

The first processing circuit 10 in the second embodiment is mounted on the substrate 3 constituting the timing controller 30. That is, the first processing circuit 10 in the second embodiment is mounted on the timing controller 30.

As described above, the configuration of the second embodiment is the same as that of the first embodiment except in the particulars described with respect to the second embodiment.

According to the second embodiment, the first processing circuit 10 outputs the expansion coefficient value (α) to the second processing circuits 20. Because of this, it is not necessary to provide a configuration to determine the expansion coefficient value in each of the processing circuits corresponding to the respective display regions, but the configuration can be concentrated in the first processing circuit 10. Consequently, smaller-scale circuits can be used to perform the expansion processing. If each of the processing circuits corresponding to the respective display regions has a configuration to determine the expansion coefficient value, the expansion coefficient values determined by the processing circuits differ from each other in some cases. If different expansion coefficient values are applied to the display regions that display one image, the image is output to the display regions with luminance levels different from each other. Thus, if each of the processing circuits has a configuration to determine the expansion coefficient value, the expansion processing cannot be appropriately performed in some cases. Due to this, in the case of such a configuration, processing is needed to match the expansion coefficient values between the processing circuits. In contrast, according to the second embodiment, the first processing circuit 10 outputs the expansion coefficient value to the second processing circuits 20, so that the unified expansion coefficient value is output to the second processing circuits 20. As a result, the second processing circuits 20 can provide the expansion for one image with the unified expansion coefficient value without performing the processing for matching the expansion coefficient values.

The timing controller 30 can more surely synchronize the second processing circuits 20.

Using the expansion coefficient value to determine the brightness of the backlight 5 can reduce the power consumption by the backlight 5 while displaying the image at exactly the same luminance as that of the input image signals.

Third Embodiment

Figure 9:
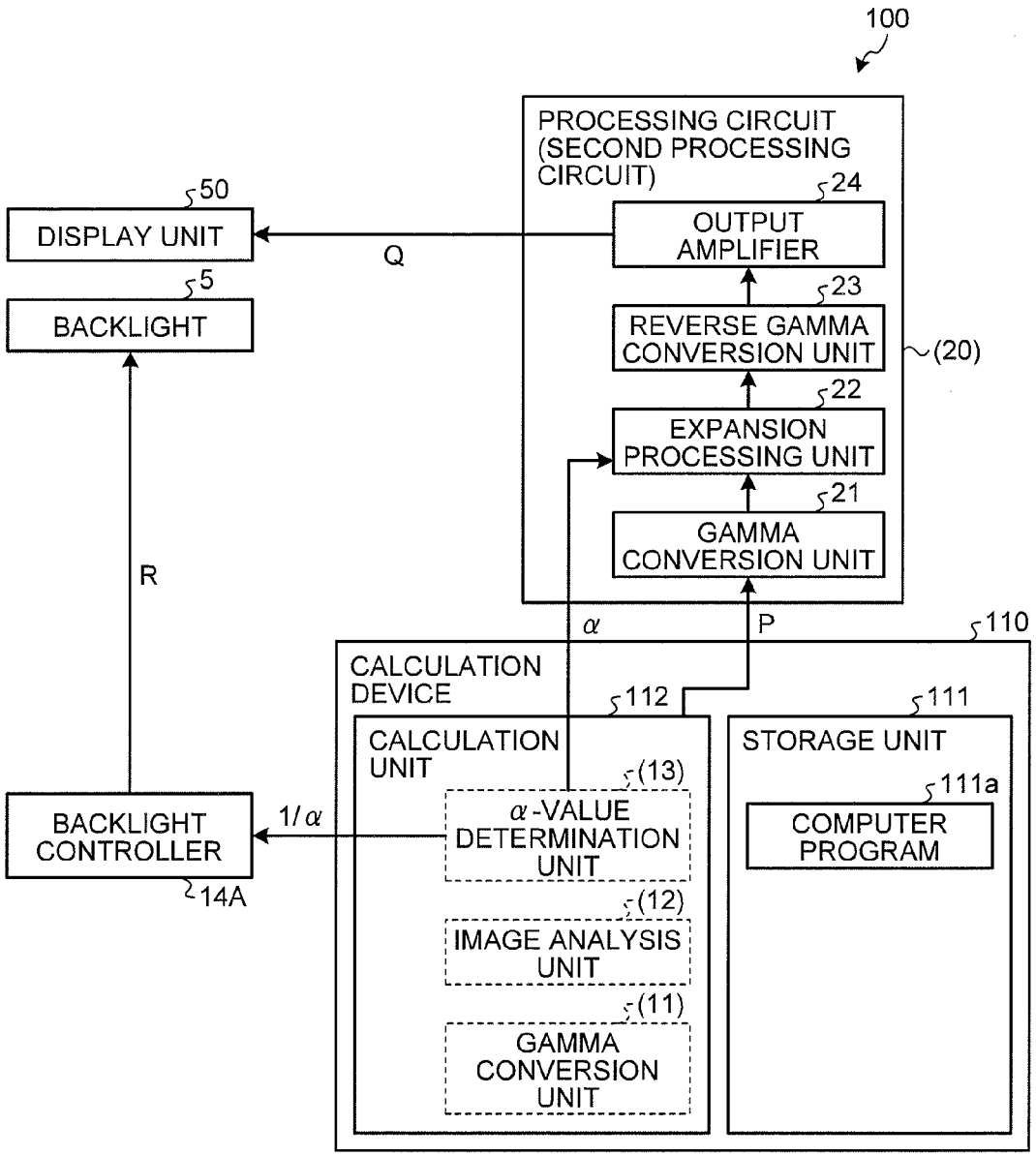
FIG. 9 is a diagram illustrating an example of a form of a display system according to a third embodiment of the present invention.

A third embodiment of the present invention will be described. FIG. 9 is a diagram illustrating an example of a form of a display system 100 according to the third embodiment of the present invention. In the description of the third embodiment, the same configuration as that of the first embodiment is denoted by the same reference numeral, and description thereof will be omitted in some cases.

The third embodiment is provided with a calculation device 110 instead of the first processing circuit 10. The calculation device 110 uses software processing to determine the expansion coefficient value that is a value for improving the luminance of an image, and outputs the expansion coefficient value and the image to the processing circuit (second processing circuit 20).

As illustrated, for example, in FIG. 9, the calculation device 110 includes a storage unit 111 and a calculation unit 112. The storage unit 111 stores a computer program 111*a* read by the calculation unit 112. The calculation unit 112 reads the computer program 111*a* from the storage unit 111 and executes the computer program 111*a* so as to serve as the gamma conversion unit 11, the image analysis unit 12, and the α-value determination unit 13 in the first embodiment. Specifically, the calculation unit 112 uses the software processing to provide the gamma conversion processing and the analysis for the input image signals, and determine the expansion coefficient value (α).

The calculation device 110 may also serve as the host CPU, or may be provided separately from the host CPU. If also serving as the host CPU, the calculation device 110 outputs the image data, and also outputs the expansion coefficient value (α) to be used for the expansion processing of the image data. If being provided separately from the host CPU, the calculation device 110 transfers, to the processing circuit, the input image signals output from the host CPU, and outputs the expansion coefficient value (α) to be used for the expansion processing of the image data.

The third embodiment is provided with a backlight controller 14A as a component separate from the calculation device 110. The backlight controller 14A has the same function as that of the backlight control unit 14 in the first embodiment. The calculation unit 112 outputs the reciprocal (1/α) of the expansion coefficient value (α) to the backlight controller 14A.

The third embodiment may be provided with a plurality of such processing circuits (second processing circuits 20) as in the case of the second embodiment. In this case, the calculation device 110 outputs the image data and the expansion coefficient value to the processing circuits.

As described above, the configuration of the third embodiment is the same as that of the first embodiment except in the particulars described with respect to the third embodiment.

According to the third embodiment, the software processing is used for the calculation of the expansion coefficient value among the processes involved in the expansion processing, so that hardware dedicated to the calculation of the expansion coefficient value can be eliminated. Because of this, more flexible response can be made, for example, to design changes and changes in specific algorithms for the calculation of the expansion coefficient value.

If the second processing circuits 20 are provided, the same effects as those of the second embodiment are obtained.

Application Example

Figure 10:
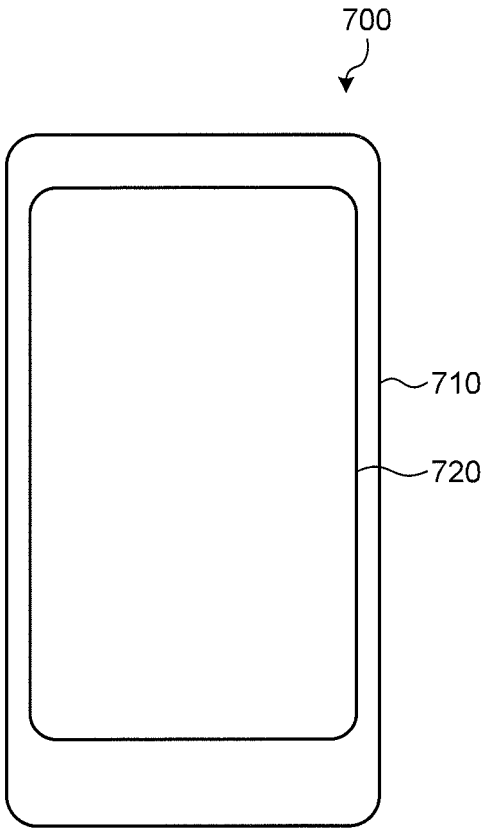
FIG. 10 is a diagram illustrating an example of an appearance of a smartphone to which the present invention is applied.

The following describes an application example of, for example, the display device described in the above embodiments with reference to FIG. 10. For example, the display device described in the above embodiments can be applied to electronic apparatuses in various fields, such as a smartphone. In other words, for example, such a display device can be applied to electronic apparatuses in various fields that display a video signal input from the outside or a video signal generated inside as an image or a video.

FIG. 10 is a diagram illustrating an example of an appearance of a smartphone 700 to which the present invention is applied. The smartphone 700 includes, for example, a display unit 720 provided on one surface of a housing 710. The display unit 720 is constituted by the display unit (such as the display unit 50) included in the display device or the display system according to the present invention. That is, the smartphone 700 includes the display device or the display system according to the present invention.

While the embodiments are described for the case of the transmissive liquid crystal display device, the case is an example of a specific form of the display device, and the invention is not limited to the example. For example, the display device may be a reflective liquid crystal display device. In this case, the backlight 5 is not provided. In this case, the control using the expansion coefficient value (α) related to the backlight 5 is omitted.

While, in the embodiments, the case of the liquid crystal display device has been illustrated as the disclosed example, other application examples include, but are not limited to, various flat panel display devices, such as organic EL display devices, other light-emitting display devices, and electronic paper display devices including, for example, electrophoretic elements. The present invention can obviously be applied to small, medium, and large size display devices without particular limitation.

The color added by the image processing is not limited to white, but can be appropriately changed according to colors of sub-pixels constituting the display unit 50. Specifically, for example, another color of sub-pixels, such as single-color yellow (Y), may be employed instead of single-color white (W). A complementary color of red (R), green (G), or blue (B) may be employed instead of single-color white (W). The expansion processing may be such processing that improves the luminance of an image while maintaining the color space represented by the input image signals.

The number of bits of the color values employed for the input image signals is merely an example, and can be changed as appropriate.

Other functions and effects obtained by the aspects described in the embodiments that are obvious from the present description and those easily conceivable by those skilled in the art are considered to be naturally provided by the present invention.

According to the embodiment, the present disclosure includes the following aspects.

(1) A display device including a first processing circuit mounted on a substrate separate from a translucent substrate constituting a display panel, and a second processing circuit mounted on the translucent substrate, wherein the first and the second processing circuits receive the same image data;

the first processing circuit includes a determination unit that uses color values of a plurality of pixels constituting an image based on the image data to determine an expansion coefficient value serving as a value for improving luminance of the image, and outputs the expansion coefficient value to the second processing circuit; and the second processing circuit includes an expansion processing unit that uses the expansion coefficient value to provide expansion processing for improving the luminance of the image for the image based on the image data.

(2) The display device according to (1), wherein each of the first and the second processing circuits includes a gamma conversion unit that performs gamma conversion processing of converting a correspondence relation between a gradation of the image based on the image data and the luminance of the image into a predetermined relation;

the determination unit uses the color values of the pixels constituting the image after being subjected to the gamma conversion processing to determine the expansion coefficient value;

the expansion processing unit provides the expansion processing for improving the luminance of the image for the image after being subjected to the gamma conversion processing; and the second processing circuit includes a reverse gamma conversion unit that returns the correspondence relation between the gradation of the image after being subjected to the expansion processing and the luminance of the image to the correspondence relation before being subjected to the gamma conversion processing.

(3) The display device according to (1), wherein the first and the second processing circuits receive each of frame images of image data including a plurality of frame images at the same time; and the expansion processing unit employs, as the expansion coefficient value to be used for the expansion processing of a certain frame image, an expansion coefficient value determined using pixels of a frame image different from the certain frame image.

(4) The display device according to (3), wherein the expansion processing unit employs, as the expansion coefficient value to be used for the expansion processing of a certain frame image, an expansion coefficient value determined using pixels of a frame image immediately before the certain frame image.

(5) The display device according to (1) further including a plurality of such second processing circuits, wherein the determination unit outputs the expansion coefficient value to the second processing circuits.

(6) The display device according to (5) further including a timing controller that synchronizes the second processing circuits with each other, wherein the first processing circuit is included in the timing controller.

(7) The display device according to (6), wherein the display panel is a transmissive liquid crystal display panel; and the timing controller includes a backlight control unit that uses the expansion coefficient value to determine brightness of a backlight of the liquid crystal display panel.

(8) A display system including a display device that includes a processing circuit mounted on a translucent substrate constituting a display panel, and a calculation device that uses software processing to determine an expansion coefficient value serving as a value for improving luminance of an image and outputs the expansion coefficient value and image data to the processing circuit, wherein the processing circuit includes an expansion processing unit that uses the expansion coefficient value to provide expansion processing for improving the luminance of the image for the image based on the image data.

(9) The display system according to (8) further including a plurality of such processing circuits, wherein the calculation device outputs the image data and the expansion coefficient value to the processing circuits.

(10) An image processing circuit mounted on a substrate separate from a translucent substrate constituting a display panel, wherein the image processing circuit receives from the outside thereof an expansion coefficient value and image data, the expansion coefficient value being determined using color values of a plurality of pixels constituting an image and serving as a value for improving luminance of the image, and the image processing circuit includes an expansion processing unit that uses the expansion coefficient value to provide expansion processing for improving the luminance of the image for the image based on the image data.

What is claimed is:

1. A display device comprising:

a first processing circuit mounted on a substrate separate from a translucent substrate constituting a display panel, and a second processing circuit mounted on the translucent substrate, wherein the first and the second processing circuits receive the same image data;

the first processing circuit includes a determination unit that uses color values of a plurality of pixels constituting an image based on the image data to determine an expansion coefficient value serving as a value for improving luminance of the image, and outputs the expansion coefficient value to the second processing circuit;

the second processing circuit includes an expansion processing unit that uses the expansion coefficient value to provide expansion processing for improving the luminance of the image for the image based on the image data each of the first and the second processing circuits includes a gamma conversion unit that performs gamma conversion processing of converting a correspondence relation between a gradation of the image based on the image data and the luminance of the image into a predetermined relation;

the determination unit uses the color values of the pixels constituting the image after being subjected to the gamma conversion processing to determine the expansion coefficient value;

the expansion processing unit provides the expansion processing for improving the luminance of the image after being subjected to the gamma conversion processing; and the second processing circuit includes a reverse gamma conversion unit that returns the correspondence relation between the gradation of the image after being subjected to the expansion processing and the luminance of the image to the correspondence relation before being subjected to the gamma conversion processing.

2. The display device according to claim 1, wherein the first and the second processing circuits receive each of frame images of image data including a plurality of frame images at the same time; and the expansion processing unit employs, as the expansion coefficient value to be used for the expansion processing of a certain frame image, an expansion coefficient value determined using pixels of a frame image different from the certain frame image.

3. The display device according to claim 2, wherein the expansion processing unit employs, as the expansion coefficient value to be used for the expansion processing of a certain frame image, an expansion coefficient value determined using pixels of a frame image immediately before the certain frame image.

4. The display device according to claim 1 further comprising a plurality of such second processing circuits, wherein the determination unit outputs the expansion coefficient value to the second processing circuits.

5. The display device according to claim 4 further comprising a timing controller that synchronizes the second processing circuits with each other, wherein the first processing circuit is included in the timing controller.

6. The display device according to claim 5, wherein the display panel is a transmissive liquid crystal display panel; and the timing controller includes a backlight control unit that uses the expansion coefficient value to determine brightness of a backlight of the liquid crystal display panel.

* * * * *